United States Patent [19]

Adachi et al.

[11] 4,121,939

[45] Oct. 24, 1978

[54] COLOR PHOTOGRAPHIC LIGHT-SENSITIVE MATERIAL CONTAINING +-ALKYL SUBSTITUTED HYDROQUINONE

[75] Inventors: Keiichi Adachi; Akio Mitsui, both of Minami Ashigara, Japan

[73] Assignee: Fuji Photo Film Co., Ltd., Minami Ashigara, Japan

[21] Appl. No.: 815,753

[22] Filed: Jul. 14, 1977

[30] Foreign Application Priority Data

Jul. 14, 1976 [JP] Japan ..... 51-84321

[51] Int. Cl.[2] ..... G03C 1/48; G03C 1/10; G03C 1/06; G03C 1/40

[52] U.S. Cl. ..... 96/77; 96/56; 96/76 R; 96/95; 96/99; 96/100 R

[58] Field of Search ..... 96/76 R, 77, 99, 100, 96/56, 95

[56] References Cited

U.S. PATENT DOCUMENTS

| | | | |
|---|---|---|---|
| 3,637,393 | 1/1972 | Sakamoto et al. | 96/100 |
| 3,935,016 | 1/1976 | Nishimura et al. | 96/56 |
| 3,982,944 | 9/1976 | Ohi et al. | 96/56 |

*Primary Examiner*—Richard C. Schilling

*Attorney, Agent, or Firm*—Sughrue, Rothwell, Mion, Zinn and Macpeak

[57] ABSTRACT

A color photographic light-sensitive material comprising a support having thereon at least one layer of a silver halide photographic emulsion with the light-sensitive material containing at least one hydroquinone compound represented by the following general formula (I):

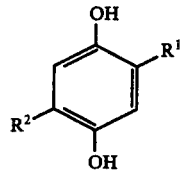

(I)

wherein $R^1$ represents a hydrogen atom,

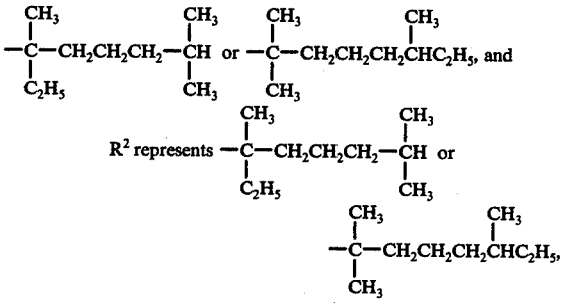

or a precursor thereof.

16 Claims, No Drawings

COLOR PHOTOGRAPHIC LIGHT-SENSITIVE MATERIAL CONTAINING +-ALKYL SUBSTITUTED HYDROQUINONE

BACKGROUND OF THE INVENTION

1. Field of the Invention

The present invention relates to a color photographic light-sensitive material which prevents color fog (also referred to as color stain) and, more particularly, to an improved silver halide color photographic material containing an oily hydroquinone derivative or derivatives as a color fog-preventing agent (or anti-stain agent).

2. Description of the Prior Art

It is known that "color fog" (or color stain) is observed with color photographic light-sensitive materials of the type which contain color-forming couplers in silver halide photographic light-sensitive emulsions and which are to be developed using a color developing agent such as p-phenylenediamine. It has long been known to use various alkylhydroquinones in order to prevent this phenomenon.

For example, U.S. Pat. No. 2,728,659, Japanese patent application (OPI) No. 106,329/74 (corresponding to U.S. Pat. No. 3,960,570), etc., describe the process of using mono straight chain alkyl-substituted hydroquinones, and U.S. Pat. No. 3,700,453, West German Patent Application (OLS) No. 2,149,789, Japanese Patent Applications (OPI) Nos. 156,438/75, 106,329/74, etc., describe the process of using mono branched chain alkyl-substituted hydroquinones. On the other hand, di-straight chain alkyl hydroquinones are described in U.S. Pat. Nos. 2,728,659, 2,732,300 (corresponding to British Pat. Nos. 752,147) and 3,243,294, *Chemical Abstracts*, Vol. 58, 6367h, etc., and di-branched chain alkylhydroquinones are described in U.S. Pat. Nos. 3,700,453, 2,732,300 and 3,243,294, *Chemical Abstracts* described above, Japanese Patent Application (OPI) No. 156,438/75, Japanese Patent Publication 21,249/75, etc.

In addition, related descriptions of the use of alkylhydroquinones as color fog-preventing agents are also given in British Pat. Nos. 558,258, 557,750 (corresponding to U.S. Pat. No. 2,360,290), 557,802, 731,301 (corresponding to U.S. Pat. No. 2,701,197), U.S. Pat. Nos. 2,336,327, 2,403,721, 3,582,333 and West German Patent Application (OLS) No. 2,505,016 (corresponding to Japanese Patent Application (OPI) No. 110,337/75).

However, disadvantages exist with conventionally employed monoalkylhydroquinones and dialkylhydroquinones. Many of them are difficult to synthesize, since the synthesis thereof involves 2 to 4 steps. Processes involving less steps require reactions to be conducted at high temperature for a long time, and thus, are synthetically unfavorable. Some hydroquinone derivatives have such a low molecular weight that they migrate through each layer in a multilayer color photographic light-sensitive material to cause unfavorable side effects. Some of the other hydroquinone derivatives have the defect that crystallization thereof occurs during or after coating, resulting in a deterioration of the quality of the coating, or the defect that an oxidation reaction occurs during coating procedures or during processings with colored by-products being formed.

On the other hand, in the field of producing color photographic light-sensitive materials, it has recently been strongly desired, in order to obtain color photographs with higher quality, to develop a novel color fog-preventing agent which more effectively prevents color fog without reducing the photographic sensitivity, which itself does not crystallize and form crystals and which contributes to an improvement of light fastness of dye images formed by color development.

The above-described requisites have been satisfied with the use of asymmetrical hydroquinone compounds having at least one tertiary alkyl group and represented by the following general formula:

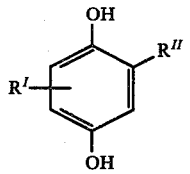

wherein $R^{I}$ represents an unsubstituted primary alkyl group, an isoalkyl group, an unsubstituted tertiary alkyl group, a tertiary cycloalkyl group, a lower alkoxy group or a halogen atom; $R^{II}$ represents an unsubstituted tertiary alkyl group or a tertiary cycloalkyl group, or a precursor of such a hydroquinone compound, which is described in U.S. patent application Ser. No. 800,817 filed May 26, 1977 (corresponding to Japanese patent application No. 63,099/75.

However, it has recently been strongly desired to develop a color fog-preventing agent having an improved stability before or during coating or during processing, in addition to the requisites described above.

SUMMARY OF THE INVENTION

Therefore, an object of the present invention is to provide novel color fog-preventing agents capable of effectively preventing color fog without reducing photographic sensitivity.

Another object of the present invention is to provide novel color fog-preventing agents which can be synthesized with ease.

A further object of the present invention is to provide novel liquid color fog-preventing agents which can advantageously be added to an aqueous hydrophilic colloid coating composition without using a solvent.

Still a further object of the present invention is to provide novel color fog-preventing agents which do not undergo, before or during coating or during processing, an oxidation and form colored by-products in an aqueous hydrophilic colloid coating composition.

Still a further object of the present invention is to provide a color photographic light-sensitive material containing the above-described color fog-preventing agent or agents.

These objects are effectively attained by using hydroquinone compounds having at least one tertiary alkyl group containing 10 carbon atoms and represented by the following general formula (I), or precursors thereof, and a color photographic light-sensitive material containing them.

DETAILED DESCRIPTION OF THE INVENTION

The term "precursors" as used herein means compounds capable of releasing hydroquinone derivatives upon hydrolysis. For example, hydroquinone derivatives wherein the hydrogen atom of one or both of the hydroxyl groups in the hydroquinone nucleus are substituted with an acyl group [the term "acyl group" being used herein in the broad sense and including, for example

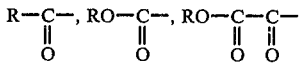

(wherein R represents an aliphatic group such as an alkyl group), etc.].

The hydroquinone compounds having tertiary alkyl groups containing 10 carbon atoms used in this invention have the general formula (I):

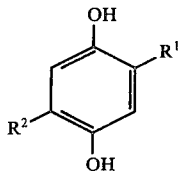

(I)

wherein $R^1$ represents a hydrogen atom,

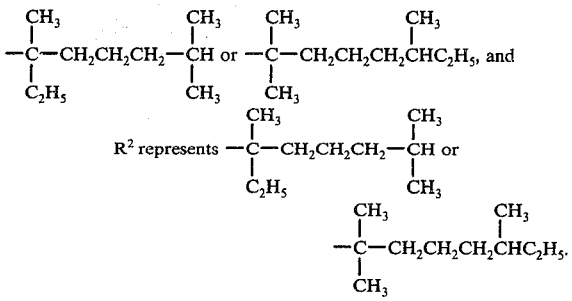

It is absolutely impossible to expect from the literature described hereinbefore that the compounds of the general formula (I) used in the present invention would show specifically remarkable effects (i.e., effects of preventing color fog with high efficiency, improving the light fastness of dye images, not precipitating upon coating or during storage, etc.).

The color fog-preventing agents of the present invention may be used individually or as a combination of two or more thereof in optional proportions, and may also be used in combination with known hydroquinone derivatives described in the literature described hereinbefore.

The hydroquinone compounds of this invention of the general formula (I) can, in general, be prepared by reacting hydroquinone and 3,7-dimethyloctan-3-ol in a suitable solvent for dissolving hydroquinone and in the presence of a catalyst at a temperature of about 40° to about 100° C. for a period of about 2 hours to about 7 hours.

In this reaction, 3,7-dimethyloctan-3-ol is used in an excess molar amount to that of the hydroquinone. Suitable solvents which can be used include alcohols, e.g., methanol, ethanol, methyl Cellosolve and the like, and a suitable amount thereof ranges from about 100 to about 300 ml/mol of hydroquinone. In addition, suitable catalysts which can be used include Lewis acids, e.g., sulfuric acid, phosphoric acid, boron trifluoride, etc.

In order to obtain a relatively large amount of monotertiary alkylhydroquinone wherein the alkyl moiety has 10 carbon atoms according to the above reaction, use of a relatively small amount of 3,7-dimethyloctan-3-ol in comparison with that required to obtain the corresponding di-tertiary alkylhydroquinone and, in addition, conducting the reaction at a relatively low temperature, i.e., about 40 to about 60° C., is recommended.

Specific examples of the synthesis of the hydroquinones of the present invention are described below. Unless otherwise indicated, all parts, percents, ratios and the like are by weight.

SYNTHESIS EXAMPLE 1

55 g of hydroquinone and 216 ml of 3,7-dimethyloctan-3-ol were dissolved in 100 ml of methanol. Then, 100 ml of concentrated sulfuric acid (36 N) was added dropwise thereto under stirring and cooling so that the temperature did not rise higher than 50° C. Subsequently, the reaction mixture was maintained at 55° to 60° C. for 4 hours. Then, the reaction mixture was added to ice-water, and extracted with 500 ml of benzene. The benzene layer was washed with water and, after drying over anhydrous sodium sulfate, benzene and unreacted 3,7-dimethyloctan-3-ol were distilled off. The residual oily product was distilled under reduced pressure to obtain 134 g of an oily product having a boiling point of 209° to 220° C./1.9 mmHg. This oily product was determined to be 2,5-bis(1-ethyl-1,5-dimethylhexyl)hydroquinone through elemental analysis and infrared absorption spectral analysis.

Elemental Analysis: Calcd. (%) for $C_{26}H_{46}O_2$: C, 79.94; H, 11.87. Found (%): C, 79.87; H 11.87.

SYNTHESIS EXAMPLE 2

55 g of hydroquinone and 71.5 g of 3,7-dimethyloctan-3-ol were dissolved in 100 ml of methanol. Then, 50 ml of concentrated sulfuric acid (36 N) was added dropwise thereto under stirring and cooling so as to maintain the temperature at 40° C. or less. Subsequently, the reaction mixture was maintained at 50° to 55° C. for 4 hours. The resulting reaction mixture was added to ice-water, and extracted with 500 ml of benzene. The benzene layer was washed with water and, after drying over anhydrous sodium sulfate, benzene and unreacted 3,7-dimethyloctan-3-ol were distilled off under reduced pressure. The residual oil was chromatographed on silica gel using benzene as a developing solvent. Thus, 29.8 g of 2,5-bis(1-ethyl-1,5-dimethylhexyl)hydroquinone (the same compound as obtained in Synthesis Example 1) was first eluted, and then 15.1 g of 2-(1-ethyl-1,5-dimethylhexyl)hydroquinone was eluted.

Elemental Analysis: Calcd. (%) for $C_{16}H_{26}O_2$: C, 76.75; H, 10.47. Found (%): C, 76.88; H, 10.48.

According to the above-described Synthesis Example 2, 2,5-bis(1-ethyl-1,5-dimethylhexyl)hydroquinone and 2-(1-ethyl-1,5-dimethylhexyl)hydroquinone were produced in a molar proportion of about 2:1. The effects of the present invention can be obtained using this mixture as such.

In addition, mass spectral data suggest that hydroquinones obtained in Synthesis Examples 1 and 2 contain isomers thereof wherein the alkyl group is a 1,1,5-trimethylheptyl group in place of a 1-ethyl-1,5-dimethylhexyl group.

The color fog-preventing agent of the present invention can be incorporated in a layer of a light-sensitive material, such as a photographic layer (in particular, a blue-sensitive silver halide emulsion layer or a green-sensitive silver halide emulsion layer) or an adjacent layer thereto, or an interlayer.

The amount of the color fog-preventing agent to be added varies depending upon factors such as the end use of the light-sensitive material, the dye image-providing materials present such as dye image-forming couplers for use in conventional color processes or dye image-providing compounds for use in color diffusion transfer processes, the silver halide emulsions employed, the development processing used, etc. However, generally speaking, a suitable amount is about 0.1 to about 200% by weight, particularly 0.2 to 150% by weight, based on the dye image-forming coupler to be used. The color fog-preventing agent may be emulsified and dispersed together with a coupler, or may be emulsified and dispersed separately from the coupler. A suitable amount of the color fog-preventing agent to be incorporated in the adjacent layer or the interlayer of a conventional color photographic light-sensitive element ranges from about 1 to about 1,000 mg/m$^2$, preferably 10 to 100 mg/m$^2$. Where the color fog-preventing agent is employed in a color diffusion transfer light-sensitive material, a suitable amount ranges from about 0.2 g to about 3 g, preferably 0.5 to 2 g/m$^2$.

The color photographic light-sensitive material of the present invention is preferably a multilayer multi-color photographic light-sensitive material comprising a support having provided thereon three silver halide emulsion layers each sensitive to different wavelength regions. One illustrative example of such a color light-sensitive material is one which comprises a support having provided thereon a red-sensitive silver halide emulsion layer containing a cyan color-forming coupler, a green-sensitive silver halide emulsion layer containing a magenta color-forming coupler, a blue-sensitive silver halide emulsion layer containing a yellow color-forming coupler and, if necessary, light-insensitive auxiliary layers such as a protective layer, a filter layer, an interlayer, an antihalation layer, etc. Another illustrative example of such a color light-sensitive material is a color diffusion transfer light-sensitive material which comprises a support having coated thereon a layer comprising a cyan dye-providing compound, a layer comprising a red-sensitive silver halide emulsion layer, an interlayer, a layer comprising a magenta dye image-providing compound, a layer comprising a green-sensitive silver halide emulsion layer, an interlayer, a layer comprising a yellow dye image-providing compound, a layer comprising a blue-sensitive silver halide emulsion layer and, if necessary, light-insensitive layers such as an image-receiving layer, a white reflective layer, an opaque layer, a filter layer and a protective layer. A cover sheet which can contain a neutralizing layer and a neutralization rate-controlling layer may be superimposed over the silver halide emulsion layer of the light-sensitive material. The stratum structure of the photographic emulsion layer can comprise a red-sensitive silver halide emulsion layer, a green-sensitive silver halide emulsion layer and a blue-sensitive silver halide emulsion layer provided in this order from a support, or can comprise the order of a blue-sensitive silver halide emulsion layer, a green-sensitive silver halide emulsion layer and a red-sensitive silver halide emulsion layer.

The color fog-preventing agent of the present invention exhibits more effects when used in combination with compounds capable of improving light fastness such as with phenolic compounds having an ether bond in the 4-position as described in Japanese Patent Application (OPI) No. 134,327/74 or α-tocopherol acetate described in Japanese Patent Application (OPI) 27,333/76. A suitable molar ratio of the color fog-preventing agent of the present invention to such a light fastness increasing compound ranges from about 0.1:1 to about 10:1, preferably 0.2:1 to 5:1.

A coupler can be incorporated in the emulsion layer of the color photographic light-sensitive material of the present invention. Non-diffusing couplers having a hydrophobic group called a ballast group in the molecule are preferred as such couplers. Either 4-equivalent or 2-equivalent couplers may be used. However, 2-equivalent couplers are particularly preferred. Also, colored couplers for color correction or couplers capable of releasing a development inhibitor upon development (so-called DIR couplers) may be incorporated into the emulsion. Couplers producing colorless coupling reaction products may also be used.

Known open chain ketomethylene couplers can be used as yellow color-forming couplers. Of these, benzoylacetanilide compounds and pivaloylacetanilide compounds are advantageous. Specific examples of usable yellow color-forming couplers are described in U.S. Pat. Nos. 2,875,057, 3,265,506, 3,408,194, 3,551,155, 3,582,322, 3,725,072, 3,891,445, West German Pat. No. 1,547,868, West German Patent Applications (OLS) Nos. 2,213,461, 2,219,917, 2,261,361, 2,263,875, 2,414,006, 2,406,087, etc.

Pyrazolone compounds, indazolone compounds, cyanoacetyl compounds, etc., can be used as magenta color-forming couplers. In particular, pyrazolone compounds are advantageous. Specific examples of usable magenta color-forming couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, 3,935,016, West German Pat. No. 1,810,464, West German Patent Applications (OLS) Nos. 2,408,665, 2,417,945, 2,418,959, 2,424,467, Japanese Patent Publication No. 6,031/65, etc.

Phenolic compounds, naphtholic compounds, etc., can be used as cyan color-forming couplers. Specific examples thereof are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, West German Patent Applications (OLS) Nos. 2,414,830, 2,454,329, Japanese Patent Application (OPI) No. 59,838/73.

Those colored couplers as described in, e.g., U.S. Pat. Nos. 3,476,560, 2,521,908, 3,034,892, Japanese Patent Publications Nos. 2,016/69, 22,335/63, 11,304/67, 32,461/69, Japanese Patent Application (OPI) 42121-77, West German Patent Applications (OLS) Nos. 2,418,959, 2,538,323, etc., can be used.

Those DIR couplers as described in, e.g., U.S. Pat. Nos. 3,227,554, 3,617,291, 3,701,783, 3,790,384, 3,632,345, West German Patent Applications (OLS) Nos. 2,414,006, 2,454,301, 2,454,329, British Pat. No. 953,454, Japanese Patent Application (OPI) 69624-77, etc., can be used.

The light-sensitive material may contain a compound capable of releasing a development inhibitor upon development other than a DIR coupler. For example, those which are described in U.S. Pat. Nos. 3,297,445, 3,379,529, West German Patent Application (OLS) No. 2,417,914, etc., can be used.

Two or more of the above-described couplers may be incorporated in the same layer, or the same coupler may be incorporated in two or more different layers.

In order to incorporate the couplers into a silver halide emulsion layer, known processes such as that described in U.S. Pat. No. 2,322,027 are suitable. Examples of such processes are as follows:

(1) A process comprising dissolving a coupler or couplers in an organic solvent which is scarcely miscible with water and which has a high boiling point (not lower than about 170° C.) such as an alkyl phthalate (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), benzoic acid ester (e.g., octyl benzoate, etc.), alkylamides (e.g., diethyllaurylamide, etc.), phenols (e.g., p-n-nonylphenol, 2-methyl-4-n-octylphenol, etc.), dispersing this coupler solution in an aqueous medium to form a dispersion, and mixing this dispersion with a photographic emulsion.

(2) A process comprising dissolving a coupler or couplers in an organic solvent which is comparatively difficultly miscible with water and which has a low boiling point, dispersing this coupler solution in an aqueous medium to form a dispersion, and mixing this dispersion with a photographic emulsion. The organic solvent used is removed during the steps of producing a light-sensitive material. Examples of suitable organic solvents which can be used for this process include ethyl acetate, cyclohexanone, β-n-butylethoxyethyl acetate, etc.

(3) A process comprising dissolving a coupler or couplers in an organic solvent which is readily miscible with water, and adding this coupler solution to a photographic emulsion. The organic solvent used may be either removed during the steps of producing the light-sensitive material or left in the emulsion layer. Illustrative organic solvents suitable for this process include dimethylformamide, dimethyl sulfoxide, N-methylpyrrolidone, glycerin, tetrahydrofuran, diethylene glycol monoacetate, diacetone alcohol, acetonitrile, methyl isobutyl ketone, etc.

(4) A process comprising dissolving a coupler or couplers in an alkaline aqueous solution, and adding this coupler solution to a photographic emulsion.

Organic solvents used for processes (1), (2) and (3) may be appropriately mixed and then used depending upon the solubility of couplers. Also, organic solvents used for processes (3) and (4) may be appropriately mixed and used. A hydrophilic high molecular material may be incorporated in the aqueous medium in which the organic solvent solution of the couplers is to be dispersed. Such hydrophilic high molecular materials are desirably well miscible with the hydrophilic binder in the photographic emulsion, with which this coupler dispersion is to be mixed. Suitable compounds can be selected from those materials which are used as binders for photographic emulsions.

The color image-forming couplers are generally employed in an amount of about $2 \times 10^{-3}$ mol to about $5 \times 10^{-1}$ mol, preferably $1 \times 10^{-2}$ mol to $5 \times 10^{-1}$ mol, per mol of silver in the emulsion layer.

Examples of dye image-providing compounds for use in color diffusion transfer include diffusible dye-releasing redox compounds (DRR compounds), diffusible dye-releasing couplers (DDR couplers), developer dyes, amidrazone type compounds and the like.

Suitable DRR compounds are disclosed in, for example, Japanese Patent Applications (OPI) Nos. 33,826/73, 114,424/74, 126,331/74, 126,332/74, 115,528/75, 104,343/76 and 7,727/77, U.S. Pat. Nos. 3,928,312, 3,931,144, 3,954,476, 3,929,760, 3,942,987 and 3,932,380, and *Research Disclosure* No. 13024 (1975).

Suitable DDR couplers are disclosed in, for example, U.S. Defensive Publication No. T-900,029 and U.S. Pat. No. 3,227,550.

Suitable dye developers are disclosed in, for example, Japanese Patent Publications Nos. 182/60 and 18,332/60 and U.S. Pat. Nos. 3,482,972, 3,544,545, 3,551,406, 3,563,739, 3,705,184 and 3,597,200.

Amidrazone type compounds are those as reported by W. Puschel in annual meeting of the Society of Photographic Scientists and Engineers (SPSE) (1974).

A wide range of supports heretofore known for photographic use can be used as the support to be used for the light-sensitive material of the present invention. For example, films of synthetic resins such as cellulose acetate, polycarbonate, polyethylene terephthalate, polystyrene, etc., baryta-coated paper, polyethylene laminated paper, glass plates, etc., can be used.

Hydrophilic colloids which can be used for the light-sensitive material of the present invention are high molecular weight materials capable of forming a coating and permeable to a development processing solution. All hydrophilic colloids thus far used for photographic use can be employed in this invention. For example, gelatin, acylated gelatin, graft gelatins, polyvinyl alcohol, polyacrylic acid salts, polyacrylamide, partially hydrolyzed products of polyvinyl acetate, polyacrylamides having been subjected to the Hofmann reaction, acrylic acid/acrylamide/N-vinylimidazole copolymers, polyvinylpyrrolidone, sodium alginate, etc., can be employed. A suitable coating amount of silver for each photographic layer employed is about 0.2 to about 4.0, preferably 0.5 to 1.5 g/m$^2$.

The hydrophilic colloidal layers of the color light-sensitive material of the present invention, in particular gelatin-containing layers, can be hardened with various cross-linking agents. For example, cross-linking agents of the non-aldehyde type such as polyoxy compounds described in Japanese Patent Publication 7,133/59, poly(1-aziridinyl) compounds described in Japanese Patent Publication No. 8,790/62, and active halogen compounds described in U.S. Pat. Nos. 3,362,827 and 3,325,287 are particularly useful for the color light-sensitive material of the present invention, although inorganic compounds (e.g., chromium salts, zirconium salts, etc.) and cross-linking agents of the aldehyde type such as mucochloric acid, 2-phenoxy-3-chloro-maleinaldehyde acid described in Japanese Patent Publication No. 1,872/71 can in many cases also be usefully employed in the present invention.

The silver halide emulsion to be used for the light-sensitive material of the present invention can be selected from a wide range of emulsions heretofore known depending on the end-use of the light-sensitive material. Suitable silver halides include silver chloride, silver chlorobromide, silver bromide, silver chlorobromoiodide, etc. These photographic emulsions may be sensitized through chemical sensitization such as sulfur sensitization, gold sensitization, reduction sensitization, etc. Furthermore, these emulsions may be stabilized with a slightly soluble silver salt-forming agent such as a mercapto compound (e.g., 1-mercapto-5-phenyltetrazole, etc.) and a stabilizer such as 5-methyl-6-hydroxy-1,3,4-triazaindolizine, etc. Also, the emulsions may contain sensitizing dyes such as cyanines and merocyanines. Commonly used negative type silver halide emulsions (i.e., surface latent image type) are particularly preferred. However, non-surface latent image type silver halide emulsions such as direct reversal emulsions (e.g., inner latent image-forming type silver halide emulsions containing an electron-capturing agent, solarization type silver halide emulsions, etc.) can also be used.

The light-sensitive material of the present invention can be used for many purposes. For example, it can be used for color positive films, color print papers, color negative films, color reversal films, film units for the color diffusion transfer process, etc.

The color photographic light-sensitive material of the present invention is processed, after image-wise exposure, using conventional processes to form color images. The main steps in the processing are color development, bleaching and fixing. If necessary, steps such as washing with water, stabilizing, etc., may also be employed. Two or more of these steps may be conducted in one bath such as a bleach-fixing bath.

The color development is usually carried out in an alkaline solution containing an aromatic primary amino developing agent. Examples of aromatic primary amino developing agent include p-phenylenediamine type developing agents. Typical examples of these developing agents include 4-amino-3-ethoxy-N,N-diethylaniline, 4-amino-3,5-dimethyl-N,N-diethylaniline, 4-amino-3-methyl-N-ethyl-N-(β-hydroxyethyl)aniline, 4-amino-3-methyl-N,N-diethylaniline, 4-amino-3-methyl-N-ethyl-N-(β-methylsulfonamidoethyl)aniline, 4-amino-3-(β-methylsulfonamidoethyl)-N-N-diethylaniline, 4-amino-N-ethyl-N-(β-hydroxyethyl)aniline, 4-amino-N,N-diethylaniline, 4-amino-N-ethyl-N-ω-sulfobutylaniline, etc.

Suitable processing procedures and processing solutions which can be employed are disclosed, for example, in U.S. Pat. Nos. 3,996,055, 3,994,729 and 3,997,348.

The processing composition (solution) which can be used to develop a color diffusion transfer light-sensitive material can be retained in a container which is rupturable when passed between a pair of juxtaposed pressure-applying rollers.

In addition, the processing composition can further contain a light-shielding agent (light-absorbent) such as carbon black.

The following examples are given to illustrate the present invention in greater detail.

EXAMPLE 1

200 mg of Color Fog-Preventing Agents (1) and (2) of the present invention synthesized in Synthesis Example 2 above and Comparative Color Fog-Preventing Agents (3) to (9) described below were respectively dissolved in a mixed solvent of 50 mg of di-butyl phthalate and 200 mg of ethyl acetate at about 80° C., and left at 5° C. for 24 hours to compare the degree of precipitation. As a result, large amounts of Comparative Color Fog-Preventing Agents (5) and (6) precipitated, and some precipitation was observed with Comparative Color Fog-Preventing Agents (3), (4), (8) and (9). On the other hand, no formation of crystals of Color Fog-Preventing Agents (1) and (2) in accordance with the present invention was observed.

Color Fog-Preventing Agent

Invention

-continued (1)

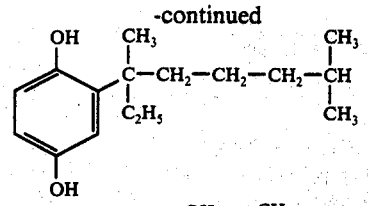

(2)

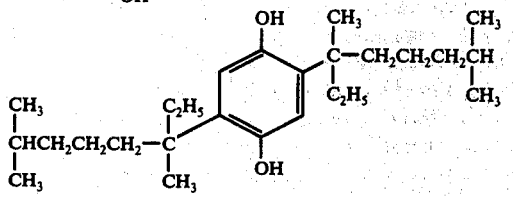

Comparison (3)

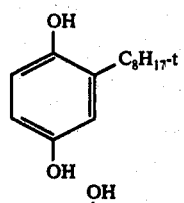

(4)

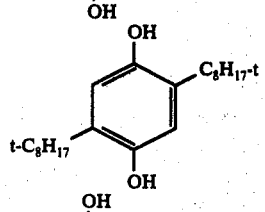

(5)

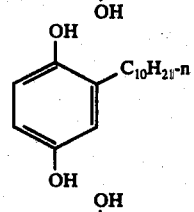

(6)

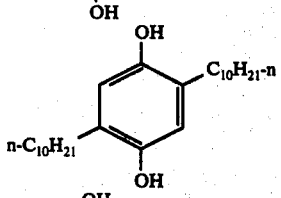

(7)

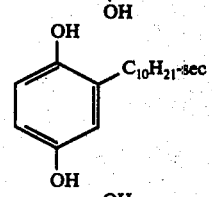

(8)

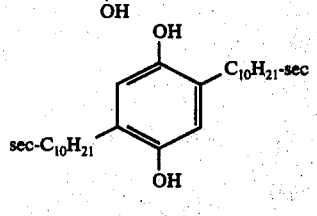

EXAMPLE 2

Emulsified Dispersion Composition A (in accordance with the present invention) having the following formulation and Emulsified Dispersion Compositions B–D (for comparison) were prepared.

| Emulsified Dispersion Composition A | |
|---|---|
| Gelatin (10% aq. soln.) | 100 ml |
| Di-n-butyl Phthalate | 5 g |
| Color Fog-Preventing Agent | 10 g |
| 2,3-Dihydroxynaphthalene | 0.2 g |
| Dodecylbenzenesulfonic Acid (5% aq. soln.) | 5 ml |

-continued

| Emulsified Dispersion Composition A | |
|---|---|
| Ethyl Acetate | 10 ml |

Composition A contained Compound (2) in Example 1 as a color fog-preventing agent, and Compositions B and C contained Compound (4) and Compound (6) in Example 1, respectively. Composition D contained no color fog-preventing agent.

Each of these Dispersions A to D was left for 4 weeks at 5° C., and filtered using a filter of a pore size of 3μ to examine the formation of crystals. Precipitation of crystals was observed with Dispersions B and C, but no precipitation was observed with Dispersions A and D.

EXAMPLE 3

On a paper support having polyethylene layers laminated on both sides were coated the following First Layer (lowermost layer) to the Sixth Layer (uppermost layer) to prepare a multilayer color light-sensitive material. (In the following table, mg/m² represents the amount coated.)

| | | |
|---|---|---|
| Sixth Layer (protective layer) | Gelatin | 1,500 mg/m² |
| Fifth layer (red-sensitive layer) | Silver chlorobromide emulsion (AgBr: 50 mol%; 300 mg silver/m²) | |
| | Gelatin | 1,500 mg/m² |
| | Cyan coupler *1 | 500 mg/m² |
| | Coupler solvent *2 | 250 mg/m² |
| Fourth Layer (UV-light absorbing layer) | Gelatin | 1,200 mg/m² |
| | UV light-absorbing agent *3 | 1,000 mg/m² |
| | Solvent for UV light-absorbing agent *2 | 250 mg/m² |
| Third Layer (green-sensitive layer) | Silver chlorobromide emulsion (AgBr: 50 mol%; 450 mg silver/m²) | |
| | Gelatin | 1,500 mg/m² |
| | Magenta coupler *4 | 400 mg/m² |
| | Coupler solvent *5 | 200 mg/m² |
| Second Layer | Gelatin | 1,000 mg/m² |
| First Layer | Silver chlorobromide emulsion (AgBr: 80 mol%; 450 mg silver/m²) | |
| | Gelatin | 1,500 mg/m² |
| | Yellow coupler *6 | 500 mg/m² |
| | Coupler solvent *7 | 500 mg/m² |
| Support | Polyethylene laminated paper | |

*1 Cyan coupler:
2-[α-(2,4-Di-t-amylphenoxy)butanamido]4,6-dichloro-5-methylphenol
*2 Coupler solvent:
Di-n-butyl phthalate
*3 UV light-absorbing agent:
2-(2-Hydroxy-3-sec-butyl-5-t-butylphenyl)benzotriazole
*4 Magenta coupler:
1-(2,4,6-Trichlorophenyl)-3-[2-chloro-5-tetradecanamido]-anilino-2-pyrazolin-5-one
*5 Coupler solvent:
o-Cresyl phosphate
*6 Yellow coupler:
α-Pivaloyl-α-[2,4-dioxo-5,5'-dimethyl-oxazolidin-3-yl]-2-chloro-5-[α-2,4-di-t-amylphenoxy)butanamido]acetanilide
*7 Coupler solvent:
o-Dioctylbutyl phosphate To the Second Layer of the above-described sample was added each of Emulsion Dispersions A, B, C and D prepared as in Example 2 in an amount of 100 mg/m² of the color fog-preventing agent to obtain Samples (i) to (iv).

Each sample was subjected to ½ second exposure to blue light, green light and red light through a continuous wedge, and to the following processings.

| Step | Time | Temperature |
|---|---|---|
| Color Development | 3 min 30 sec | 31° C |
| Bleach-Fixing | 1 min 30 sec | " |
| Washing | 2 min | " |
| Drying | | |

The processing solutions used had the following compositions.

| Composition of the Color Developer | |
|---|---|
| Benzyl Alcohol | 15 ml |
| Sodium Sulfite | 5 g |
| Potassium Bromide | 0.5 g |
| Hydroxylamine Sulfate | 2.0 g |
| Sodium Carbonate | 30.0 g |
| Sodium Nitrilotriacetate | 2.0 g |
| 4-Amino-3-methyl-N-(β-methanesulfonamido)-ethylaniline | 5.0 g |
| Water to make | 1,000 ml (pH 10.1) |

| Composition of the Bleach-Fixing Solution | |
|---|---|
| Ammonium Thiosulfate | 105 g |
| Sodium Sulfite | 2 g |
| Disodium Ethylenediaminetetraacetate | 40 g |
| Sodium Carbonate (monohydrate) | 5 g |
| Water to make | 1,000 ml (pH 7.0) |

Separately, Sample (v) comprising a polyethylene laminated paper support having coated thereon only the First Layer (blue-sensitive layer) and the Sixth Layer (protective layer), and Sample (vi) comprising a polyethylene laminated paper having coated thereon only the Third Layer (green-sensitive layer) and the Sixth Layer (protective layer) were prepared, and exposed and developed in the same manner as with Samples (i) to (iv). The green density and blue density of the thus-obtained samples were measured using an automatic recording densitometer (FAD), Fuji Model TCD-S (manufactured by Fuji Photo Film Co., Ltd.). The purity of the colors of the respective samples obtained by comparing the densities of multilayer colored Samples (i) to (iv) with that of monolayer colored Samples (v) to (vi) are shown in Table 1 below.

TABLE 1

| | Sample | | | |
|---|---|---|---|---|
| | (i) | (ii) | (iii) | (iv) |
| Stains of G → B | 0.07 | 0.10 | 0.12 | 0.16 |
| Stains of B → G | 0.01 | 0.03 | 0.06 | 0.11 |

In the above table, "Stains of G → B" means the values obtained by comparing the magenta color component of the maximum yellow color density of the multilayered sample with that of the yellow monolayer colored Sample (v). The smaller the value is, the smaller is the degree of stain. Similarly, "Stains of B → G" means the relative values of the yellow color component in the magenta color density.

As is clear from the results in the above table, it was found that Sample (i) using the color fog-preventing agent of the present invention showed a marked color stain-preventing effect and enabled the color purity of each layer to be maintained at a high level.

Furthermore, precipitation of crystals was observed with Samples (ii) and (iii) using the color fog-preventing agents outside the scope of the present invention, whereas precipitation of crystals was not observed in any state with Sample (i) using the color fog-preventing agent of the present invention. It is seen from this that the property of the dispersion of the present invention as being extremely stable is quite valuable for incorporating color fog-preventing agents in such incorporated-coupler type color light-sensitive materials.

EXAMPLE 4

Samples (i) and (ii) as described in Example 3 were exposed to blue light, green light and red light through a continuous wedge, and subjected to the same development processings as described in Example 3. Each of the resulting samples was irradiated with light (200,000 lux) for 24 hours using a xenon lamp Fade-Ometer to test light fastness.

The degree of reduction in density after the test as compared with a density of 1.5 before the test was measured. The results obtained are given in Table 2 below.

TABLE 2

| Color Image | Reduction in Density | |
|---|---|---|
| | Sample (i) | Sample (ii) |
| Yellow (blue-sensitive layer) | 0.22 | 0.30 |
| Magenta (green-sensitive layer) | 0.28 | 0.31 |
| Cyan (red-sensitive layer | 0.10 | 0.10 |

As is clear from the results in Table 2 above, it is seen that Sample (i) of the present invention had improved color images as compared with comparative Sample (ii) using Compound (4) described above heretofore used as a color fog-preventing agent.

EXAMPLE 5

On a cellulose triacetate film support were coated, in sequence, the following different layers to prepare control Sample (vii).

First Layer: Red-sensitive silver halide emulsion layer

A layer provided by coating a red-sensitive gelatino-silver bromoiodide highly sensitve emulsion (AgI content: 5 mol%; weight ratio of silver to gelatin: 1/1.5) in a silver amount of 30 mg/100 cm$^2$ and a cyan color coupler in a coupler amount of 6.8 mg/100 cm$^2$. (Thickness*: 3 $\mu$)

Second Layer: Interlayer mainly comprising gelatin (Thickness: 1 $\mu$)

Third Layer: Green-sensitive silver halide emulsion layer

A layer provided by coating a green-sensitive gelatino-silver bromoiodide highly sensitive emulsion (AgI content and with the ratio of silver/gelatin being the same as in the First Layer) in a silver amount of 25 mg/100 cm$^2$ and a magenta color coupler in a coupler amount of 5.3 mg/100 cm$^2$. (Thickness: 3 $\mu$)

Fourth Layer: Yellow filter layer

A layer provided by coating a gelatin containing yellow colloidal dispersion of silver in a silver amount of 2.5 mg/100 cm$^2$. (Thickness: 3 $\mu$)

Fifth Layer: Blue-sensitive silver halide emulsion layer

A layer provided by coating a gelatino-silver bromoiodide highly sensitive emulsion (the AgI content and the silver/gelatin ratio being the same as in the First Layer) in a silver amount of 20 mg/100 cm$^2$ and a yellow color coupler in a coupler amount of 9.8 mg/100 cm$^2$. (Thickness: 3 $\mu$)

Sixth Layer: Protective layer

A layer mainly comprising gelatin (Thickness: 1.5 $\mu$) Thickness means dry thickness.

The couplers for the first, third and fifth layers were each dissolved in tricresyl phosphate, and emulsified and dispersed in gelatin for use.

To each of the First Layer, Third Layer and Fifth Layer was added 4-hydroxy-6-methyl-1,3,3a,7-tetrazaindene as a stabilizer in an amount of $20 \times 10^{-3}$ g/m$^2$, and to the First to Fifth Layers were added sodium dodecylbenzenesulfonate as a coating aid, and triacryloylhexahydrotriazine as a hardener in an amount of $6 \times 10^{-3}$ g/m$^2$.

The following couplers were used as the cyan color coupler, the magenta color coupler and the yellow color coupler.

Cyan Coupler: 1-Hydroxy-N-[$\gamma$-(2,4-di-tert- amylphenoxypropyl)]-2-naphthamide Magenta Coupler: 1-(2,4,6-Trichlorophenyl)-3-[3-(2,4-di-tert-amylphenoxyacetamido)benzamido]-5-pyrazolone Yellow Coupler: The same yellow coupler as described in Example 3.

Sample (viii) (present invention) was prepared in the same manner as Sample (vii) using an emulsion prepared by dissolving Compound (1) described above together with the yellow color coupler in tricresyl phosphate and emulsifying and dispersing the mixture in gelatin as an emulsion for the blue-sensitive silver halide emulsion layer (Fifth Layer). Compound (1 ) was added so as to be coated in an amount of 0.4 mg/100 cm$^2$.

Sample (ix) (for comparison)

Compound (3) described above was used in place of Compound (1) in Sample (viii).

Sample (x) (for comparison)

Compound (4) described above was used in place of Compound (1) in Sample (viii).

Sample (xi) (for comparison)

Compound (5) described above was used in place of Compound (1 ) in Sample (viii).

Samples (vii) to (xi) were stepwise exposed using white light, and development-processed according to the following color negative processings.

| Processing Step | Temperature | Time |
|---|---|---|
| Color Development | 38° C | 3 min 15 sec |
| Stopping | " | 1 min |
| Washing | " | 1 min |
| Bleaching | " | 2 min |
| Washing | " | 1 min |
| Fixing | " | 2 min |
| Washing | " | 1 min |
| Stabilizing Bath | " | 1 min |

The processing solutions used possessed the following composition.

| Color Developer | |
|---|---|
| Sodium Hydroxide | 2 g |
| Sodium Sulfite | 2 g |
| Potassium Bromide | 0.4 g |
| Sodium Chloride | 1 g |
| Borax | 4 g |

-continued

| | |
|---|---|
| Hydroxylamine Sulfate | 2 g |
| Disodium Ethylenediaminetetraacetate (dihydrate) | 2 g |
| 4-Amino-3-methyl-N-ethyl-N-(β-hydroxyethyl)aniline Monosulfate | 4 g |
| Water to make the total | 1 l |
| **Stopping Solution** | |
| Sodium Thiosulfate | 10 g |
| Ammonium Thiosulfate (70% aq. soln.) | 30 ml |
| Acetic Acid | 30 ml |
| Sodium Acetate | 5 g |
| Potassium Alum | 15 g |
| Water to make the total | 1 l |
| **Bleaching Bath** | |
| Fe(III)-Sodium Ethylenediaminetetraacetate (dihydrate) | 100 g |
| Potassium Bromide | 50 g |
| Ammonium Nitrate | 50 g |
| Boric Acid | 5 g |
| Aqueous Ammonium | to adjust pH to 5.0 |
| Water to make the total | 1 l |
| **Fixing Solution** | |
| Sodium Thiosulfate | 150 g |
| Sodium Sulfite | 15 g |
| Borax | 12 g |
| Glacial Acetic Acid | 15 ml |
| Potassium Alum | 20 g |
| Water to make the total | 1 l |
| **Stabilizing Solution** | |
| Boric Acid | 5 g |
| Sodium Citrate | 5 g |
| Sodium Metaborate (tetrahydrate) | 3 g |
| Potassium Alum | 15 g |
| Water to make the total | 1 l |

The yellow density (Y) in the unexposed areas of the thus-processed and dried samples was measured using a Fuji Model TCD-S (manufactured by Fuji Photo Film Co., Ltd.) automatic densitometer. The results thus obtained are shown in Table 3 below.

TABLE 3

| | Sample | | | | |
|---|---|---|---|---|---|
| | (vii) | (viii) | (ix) | (x) | (xi) |
| Y | 0.23 | 0.14 | 0.15 | 0.19 | 0.17 |

As is clear from the results in Table 3, less color fog occurred with Sample (viii) containing the color fog-preventing agent of the present invention, thus showing the effectiveness of the present invention.

Precipitation of crystals occurred in Samples (ix) to (xi) using color fog-preventing agents outside the scope of the present invention either before or after coating. On the other hand, no precipitation of crystals was observed with Sample (viii) in accordance with the present invention.

EXAMPLE 6

On a poly(ethylene terephthalate) film support were coated, in sequence, the following layers to prepare a film unit (light-sensitive sheet) for the color diffusion transfer process. All materials (additives) used herein are conventional except for the hydroquinone derivative of the present invention. The stratal structure employed is also conventional.

(1) An image-receiving layer comprising 4.0 g/m$^2$ of copoly-[styrene-N-vinylbenzyl-N,N,N-trihexylammonium chloride] and 4.0 g/m$^2$ of gelatin.

(2 ) A white reflective layer comprising 22 g/m$^2$ of titanium dioxide and 2.2 g/m$^2$ of gelatin.

(3) An opaque layer comprising 2.7 g/m$^2$ of carbon black and 2.7 g/m$^2$ of gelatin.

(4) A layer comprising 0.5 g/m$^2$ of the cyan dye-providing compound having the following formula, 0.10 g/m$^2$ of N,N-diethyllaurylamide and 1.2 g/m$^2$ of gelatin.

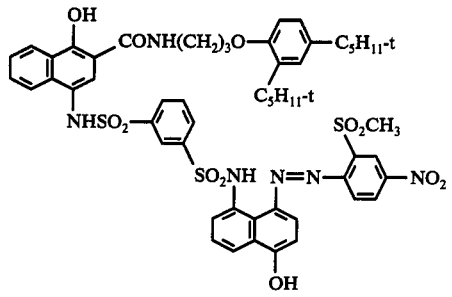

(5) A layer comprising a red-sensitive inner latent image type silver bromoiodide emulsion containing 2 mol% of silver iodide (1.1 g/m$^2$ of gelatin and 1.4 g/m$^2$ of silver), 0.007 g/m$^2$ of 3-formylethyl-2-methylbenzothiazolium bromide and 0.067 g/m$^2$ of sodium 2-pentadecylhydroquinone-5-sulfonate.

(6) An interlayer comprising 1.5 g/m$^2$ of 2,5-bis(1-ethyl-1,5-dimethylhexyl)hydroquinone synthesized as described in Synthesis Example 1 and 1.5 g/m$^2$ of gelatin.

(7) A layer comprising 1.02 g/m$^2$ of the magenta dye image-providing compound having the following formula, 0.21 g/m$^2$ of N,N-diethyllaurylamide and 1.14 g/m$^2$ of gelatin.

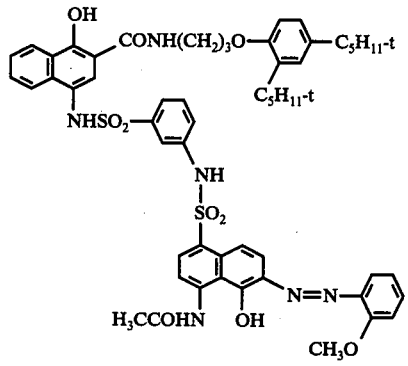

(8) A layer comprising a green-sensitive inner latent image type silver bromoiodide emulsion containing 2 mol% of silver iodide (1.1 g/m$^2$ of gelatin; 1.4 g/m$^2$ of silver), 0.010 g/m$^2$ of 3-formylethyl-2-methylbenzothiazolium bromide, and 0.067 g/m$^2$ of sodium 2-pentadecylhydroquinone-5-sulfonate.

(9) An interlayer comprising 1.2 g/m$^2$ of 2,5-bis(1-ethyl-1,5-dimethylhexyl)hydroquinone, and 1.2 g/m$^2$ of gelatin.

(10) A layer comprising 1.01 g/m$^2$ of the yellow dye image-providing compound of the following formula, 0.83 g/m$^2$ of N,N-diethyllaurylamide, and 1.09 g/m$^2$ of gelatin.

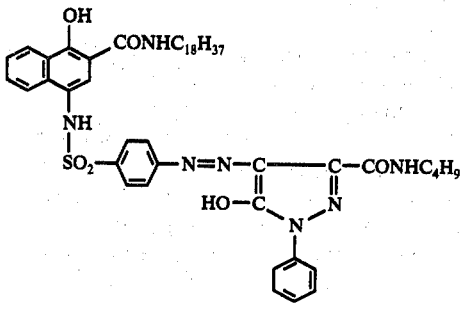

(11) A layer comprising a blue-sensitive inner latent image type silver bromoiodide emulsion containing 2 mol% of silver iodide (1.1 g/m² of gelatin; 1.4 g/m² of silver), 0.012 g/m² of 3-formylethyl-2-methylbenzothiazolium bromide, and 0.067 g/m² of sodium 2-pentadecylhydroquinone-5-sulfonate.

(12) A layer of 1.3 g/m² of gelatin.

Then, a cover sheet and a processing solution were prepared.

On a transparent polyethylene terephthalate film support were coated, in sequence, the following layers to prepare the cover sheet.

(1) A neutralizing layer comprising 10 g/m² of polyacrylic acid.

(2) A timing layer comprising 10 g/m² of cellulose acetate.

The following components were mixed to prepare a processing solution.

| | |
|---|---|
| Potassium Hydroxide | 56 g |
| t-Butylhydroquinone | 0.2 g |
| 4-Hydroxymethyl-4-methyl-1-phenyl-3-pyrazolidone | 8 g |
| 5-Methylbenzotriazole | 2.4 g |
| Carbon Black | 40 g |
| Hydroxyethyl Cellulose | 25 g |
| Distilled water to make the total | 1,000 ml |

The above-described light-sensitive sheet was exposed through a multi-color wedge, and the above-described processing solution was spread, in a thickness of 100 μ, between the above-described cover sheet and the light-sensitive sheet. After 15 minutes, a good multi-color image was viewed through the support of the light-sensitive sheet.

EXAMPLE 7

To a mixture of 5 ml of tricresyl phosphate and 10 ml of ethyl acetate were dissolved 10 g of the magenta coupler as described in Example 3 and 2 g of the hydroquinone compound of the present invention, 2,5-bis(1-ethyl-1,5-dimethylhexyl)hydroquinone or 2,5-bis(1,1,5-trimethylheptyl)-hydroquinone. The resulting solution was emulsified and dispersed into 80 ml of an aqueous solution containing 10% by weight of gelatin in the presence of sodium dodecylbenzene sulfonate (Emulsified Dispersion A).

On the other hand, the above-described procedure was repeated except using the following comparative compounds instead of the compound of this invention.

| Compounds for Comparison | Emulsified Dispersion |
|---|---|
| 2-Methyl-5-t-octyl hydroquinone Compound (A) | B |
| 2-t-Butyl-5-t-amyl hydroquinone | C |

-continued

| Compounds for Comparison | Emulsified Dispersion |
|---|---|
| Compound (B) 2-t-Hexyl-5-t-octyl hydroquinone Compound (C) | D |

Comparsion Compounds A, B and C correspond respectively to Compounds (1), (4) and (6) as described in Japanese Patent Application No. 63,099/75.

These emulsified dispersions were left at room temperature (25° C. ± 5° C.) for four weeks and then were dissolved by heating at 40° C.

The resulting solutions were each filtered through Toyo filter paper No. 3. The weight of the residues which were each obtained on the filter paper are shown in Table 4 below.

TABLE 4

| Emulsified Dispersion | Residue |
|---|---|
| A | 0 |
| B | 0.8 g |
| C | 1.0 g |
| D | 1.0 g |

The results shown in Table 4 above demonstrate that Emulsified Dispersion A containing the compound of this invention is superior in terms of the stability of the hydroquinone compound therein with the lapse of time to Emulsified Dispersions B, C and D containing the Comparison Compounds.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having thereon at least one layer of a silver halide photographic emulsion with the light-sensitive material containing at least one hydroquinone compound represented by the following general formula (I):

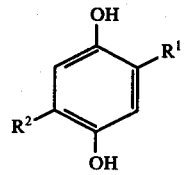

(I)

wherein $R^1$ represents a hydrogen atom,

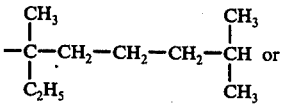

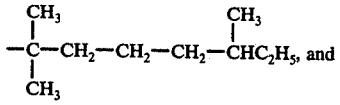

$R^2$ represents

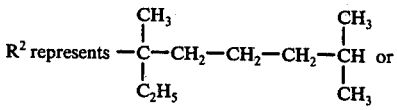

-continued

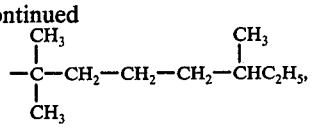

or a precursor thereof.

2. The color photographic light-sensitive material of claim 1, wherein the silver halide photographic emulsion contains a dye image-forming coupler or is associated with a dye image-providing compound for use in the color diffusion transfer processes.

3. The color photographic light-sensitive material of claim 2, wherein the hydroquinone compound is present in an amount of about 0.1 to about 200% by weight to the amount of the dye image-forming coupler present in the photographic emulsion layer.

4. The color photographic light-sensitive material of claim 3, wherein the hydroquinone compound is present in an amount of 0.2 to 150% by weight to the amount of the dye image-forming coupler present.

5. The color photographic light-sensitive material of claim 1, wherein the hydroquinone compound is present in said layer of said silver halide photographic emulsion, in a layer adjacent thereto or in an interlayer, wherein if only one silver halide photographic emulsion layer is present said hydroquinone compound if not present in a silver halide photographic emulsion layer is present in a layer adjacent thereto, whereas if more than one silver halide photographic emulsion layer is present said hydroquinone compound may be present in said interlayer.

6. The color photographic light-sensitive material of claim 5, wherein said layer of the silver halide photographic emulsion is a layer of a blue-sensitive silver halide emulsion or a layer of a green-sensitive silver halide emulsion layer.

7. The color photographic light-sensitive material of claim 5, wherein the hydroquinone compound is present in said adjacent layer.

8. The color photographic light-sensitive material of claim 5, wherein the hydroquinone compound is present in said interlayer.

9. The color photographic light-sensitive material of claim 1, wherein the hydroquinone compound is present in a layer adjacent the layer of said silver halide photographic emulsion or in an interlayer of the light-sensitive material in an amount of about 1 to about 1,000 mg/m$^2$.

10. The color photographic light-sensitive material of claim 9, wherein the hydroquinone compound is present in an amount of 10 to 100 mg/m$^2$.

11. The color photographic light-sensitive material of claim 1, wherein said color photographic light-sensitive material is a color diffusion transfer light-sensitive material and the hydroquinone compound is present in a layer adjacent the layer of said halide photographic emulsion or in an interlayer in an amount of 0.2 to 3 g/m$^2$.

12. The color photographic light-sensitive material of claim 11, wherein the hydroquinone compound is present in an amount of 0.5 to 2 g/m$^2$.

13. The color photographic light-sensitive material of claim 1, wherein said hydroquinone compound is an oily material.

14. The color photographic light-sensitive material of claim 1, wherein said hydroquinone compound is added to said color photographic light-sensitive material without using a solvent.

15. The color photographic light-sensitive material of claim 1, wherein said hydroquinone compound is

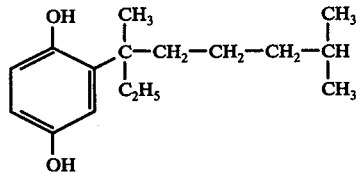

16. The color photographic light-sensitive material of claim 1, wherein said hydroquinone compound is

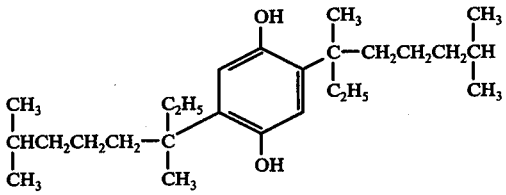

* * * * *